US006589623B2

(12) United States Patent
Roth

(10) Patent No.: US 6,589,623 B2
(45) Date of Patent: Jul. 8, 2003

(54) DUPLEX LABEL POCKET

(75) Inventor: Joseph D. Roth, Springboro, OH (US)

(73) Assignee: NCR Corporation, Dayton, OH (US)

( * ) Notice: Subject to any disclaimer, the term of this patent is extended or adjusted under 35 U.S.C. 154(b) by 138 days.

(21) Appl. No.: 09/815,371

(22) Filed: Mar. 22, 2001

(65) Prior Publication Data

US 2002/0134497 A1 Sep. 26, 2002

(51) Int. Cl.[7] ..... B42D 15/00

(52) U.S. Cl. ..... 428/40.1; 156/247; 156/249; 156/277; 283/81; 283/101; 283/105; 428/41.9; 428/42.1; 428/42.2; 428/42.3; 428/43; 428/192; 428/194

(58) Field of Search ..... 428/40.1, 41.9, 428/42.1, 42.2, 42.3, 43, 192, 194; 283/81, 101, 105; 156/247, 249, 277

(56) References Cited

U.S. PATENT DOCUMENTS 5,336,541 A 8/1994 Kobayashi ..... 428/40.1
5,580,640 A 12/1996 Kraft et al. ..... 428/195
6,186,554 B1 * 2/2001 Raming ..... 283/81
6,268,032 B1 7/2001 Mertens et al. ..... 428/40.1
6,403,184 B1 * 6/2002 Michlin ..... 428/40.1

OTHER PUBLICATIONS

Scan Tech News Online, "Linerless label printing: New technology with proven savings," Nov., 1996, two pages.

* cited by examiner

*Primary Examiner*—Nasser Ahmad
(74) *Attorney, Agent, or Firm*—Francis L. Conte

(57) ABSTRACT

A duplex laminate includes first and second facesheets laminated together. The first facesheet has a central pocket and surrounding adhesive pocket rim. The second facesheet has a central adhesive label opposite the pocket, and a surrounding border liner opposite the rim. The label is removable from the pocket for separate use therefrom, and the pocket is separately usable by removing the liner therefrom.

26 Claims, 5 Drawing Sheets

DUPLEX LABEL POCKET

CROSS REFERENCE TO RELATED APPLICATION

The present invention relates to application Ser. No. 09/775,998, filed Feb. 2, 2001, pending and entitled "Duplex Label Laminate."

BACKGROUND OF THE INVENTION

The present invention relates generally to labels, and, more specifically, to pressure sensitive labels.

Pressure sensitive labels are commonly used as shipping labels applied to a container or package for delivery in any suitable manner. In a typical purchasing transaction, for example, a customer places an order for one or more items being purchased, and a packing list is generated listing the items to be shipped to the customer through a common delivery surface.

The items are packaged in a suitable shipping container, and the shipping label is applied thereto. And, the packing list is typically inserted in a holder or pouch specifically configured therefor which is bonded to the outside surface of the container.

This shipping process accordingly requires a separate shipping label, packing list, and holder therefor which must be separately manufactured and used.

Accordingly, it is desired to provide an improved label construction which integrates the label and holder therefor in a common laminate.

BRIEF SUMMARY OF THE INVENTION

A duplex laminate includes first and second facesheets laminated together. The first facesheet has a central pocket and surrounding adhesive pocket rim. The second facesheet has a central adhesive label opposite the pocket, and a surrounding border liner opposite the rim. The label is removable from the pocket for separate use therefrom, and the pocket is separately usable by removing the liner therefrom.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
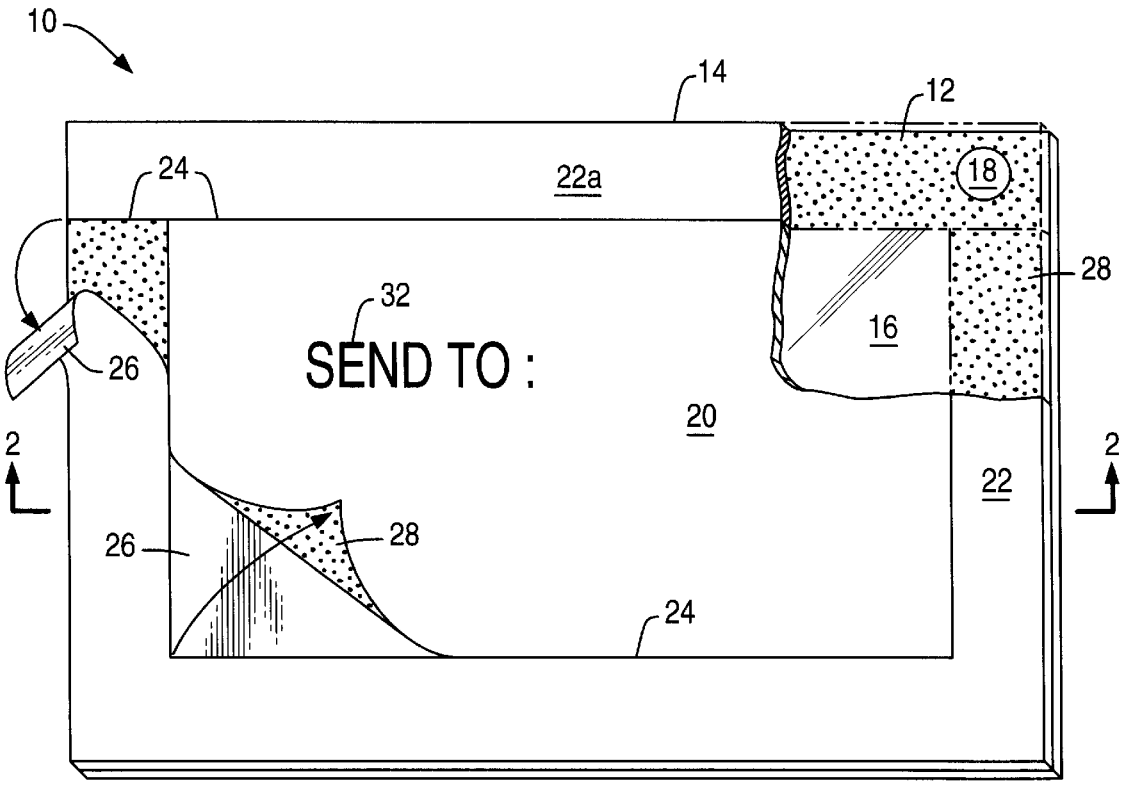
FIG. 1 is a plan view of a duplex laminate in accordance with an exemplary embodiment.

Illustrated in FIG. 1 is a duplex laminate 10 in accordance with an exemplary embodiment of the present invention. The laminate includes first and second facesheets 12,14 laminated coextensively together. Both facesheets may be conventional paper of 20 or 24 pound weight, and about 4 mils thick, or may be formed of any other suitable material composition, weight, and thickness as desired.

The first facesheet 12 includes a flat central area or pocket 16 and a laterally surrounding adhesive pocket border or rim 18, preferably in a unitary construction.

The second facesheet 14 includes a central adhesive label 20 laminated to the pocket 16, and a laterally surrounding border or rim liner 22 laminated to the pocket rim. As indicated above, both facesheets are preferably standard paper which provides structural integrity to the laminate thereof. The border liner 22 is thusly formed of standard paper and not typical liner paper.

A typical liner is in the form of supercalendered kraft paper which is thinner than label facesheet stock, and is weaker due to damage to the paper fibers therein. Pores in the liner are substantially eliminated for reducing the amount of silicone release agent needed to treat its surface, and the liner is exceptionally smooth and translucent, and not readily printable. The liner is, accordingly, specially manufactured and typically accounts for almost half the cost of producing the typical label laminate.

The second facesheet 14 and the border liner 22 are preferably standard paper, and not supercalendered kraft paper, although such kraft paper could be used in alternate embodiments if desired.

As indicated above, the pocket 16 and rim 18 are preferably integral portions of the first facesheet 12 in a unitary construction for enhanced structural integrity. However, the liner 22 adjoins the label 20 at a corresponding diecut 24 in the second facesheet 14 to permit unrestrained separation of the label 20 from the laminate when desired.

Figure 2:
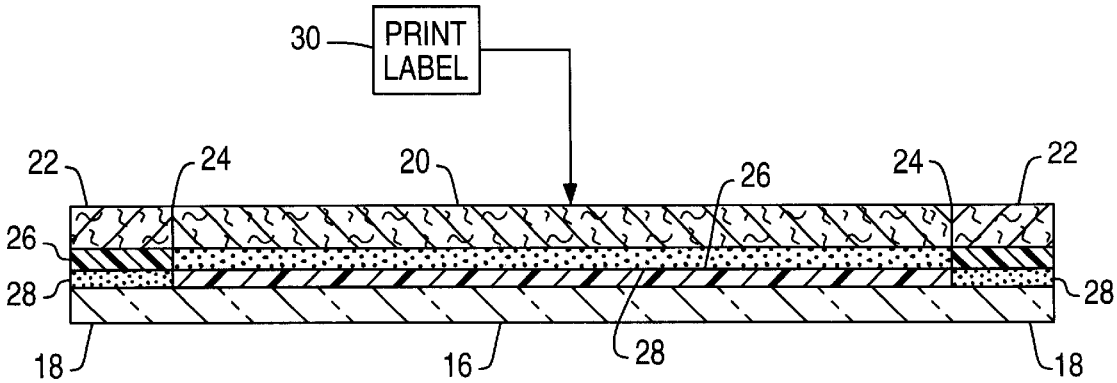
FIG. 2 is a sectional view through the laminate illustrated in FIG. 1 and taken along line 2—2.

As shown in FIGS. 1 and 2, the pocket 16 and liner 22 include a suitable release 26 covering the inside surfaces thereof to permit delamination from the corresponding label and pocket rim. The release 26 may have any conventional composition, such as the typical silicone release agent found in the supercalendered kraft paper liners which prevent permanent bonds of adhesive thereto.

Correspondingly, the label 20 and pocket rim 18 include a suitable adhesive 28 covering the inside surfaces thereof opposite to the corresponding release 26 provided on the pocket and liner. The adhesive 28 may have any conventional composition, such as pressure sensitive adhesive typically used in label construction so that the label and rim are removably bonded atop the release 26 covering the pocket and liner, respectively.

The pressure sensitive adhesive 28 forms a weak bond with the release coated surfaces of the facesheets for maintaining original structural integrity of the laminate, but permitting delamination thereof when desired. The pressure sensitive adhesive forms a permanent bond with the label and rim to which it is applied, and permits that label and rim to form a permanent bond to typical surfaces upon which those components may be applied.

The duplex laminate construction illustrated in FIGS. 1 and 2 provides complementary adhesive and release portions on each of the two facesheets in the original laminated construction thereof. The diecut 24 severs or interrupts the structural continuity of the second facesheet 14 and permits the label 20 to be readily removed from the underlying pocket 16 by simply being peeled away therefrom.

Correspondingly, the liner 22 may be similarly removed from the rim 18 also by being peeled away therefrom. The liberated label 20 may then be used in any conventional manner and re-applied to any desired surface for being bonded thereto using the same adhesive 28 covering the bottom surface of the label. The entire first facesheet 12 may then be adhesively bonded to any desired surface using the same adhesive 28 provided around the rim 18 thereof. The liner 22 may then be simply discarded as waste.

This relatively simple duplex laminate construction may have various configurations and forms for use in various applications as desired. For example, the embodiment illustrated in FIG. 1 includes the liner 22 fully surrounding the label 20 placed centrally therein both horizontally and vertically. And, the diecut 24 fully severs the label 20 from the surrounding liner 22. In this way, the label 20 may be readily removed from the laminate without disturbing the liner 22 which remains bonded to the pocket rim 18. However, the liner 22 may be separately removed from the first facesheet 12 when desired.

The label 20 illustrated in FIG. 1 is in the exemplary form of a simple rectangle which may be longer than wide or square as desired. And, the liner 22 correspondingly includes four strips surrounding the central label 20 in a correspondingly larger rectangle. The diecut 24 correspondingly includes four straight sections corresponding with the four straight edges of the label 20. In alternate embodiments, the label 20 could be circular or any desired shape, with the shape of the surrounding liner 22 being complementary thereto.

In the preferred embodiment illustrated in FIG. 1 the top liner strip designated 22*a* adjoins the top edge of the label 20 and the remaining portions of the liner 22 as a full width horizontal strip having a common and straight diecut 24 extending continuously between the opposite ends of the laminate. In this way, the remaining three-strip liner 22 is separately removable from the top liner strip 22*a* for advantages described hereinbelow.

In the preferred embodiment illustrated in FIG. 1, the pocket 16 and the entire first facesheet 12 are preferably opaque, which corresponds to the ordinary paper construction thereof.

Figure 3:
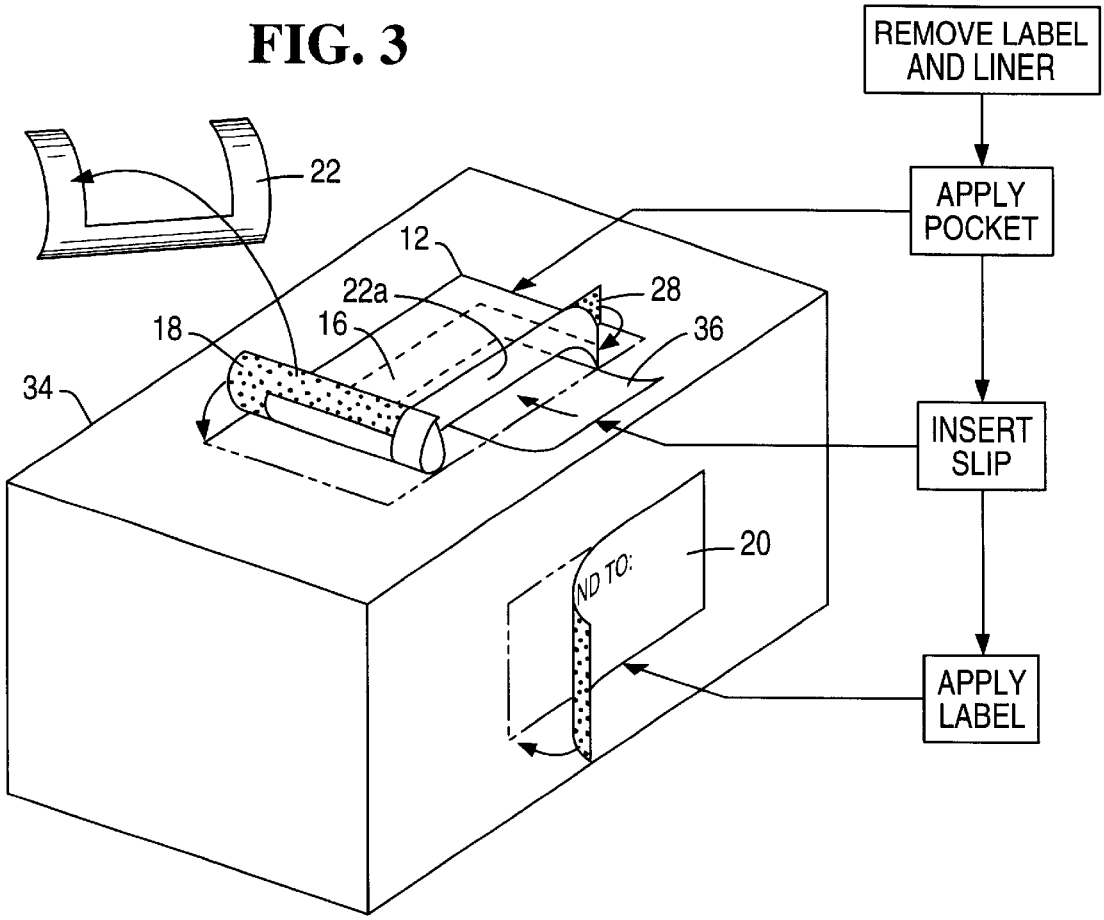
FIG. 3 is an isometric view of a shipping container upon which the laminate of FIG. 1 may be applied in an exemplary method.

FIG. 3 illustrates in flowchart form an exemplary method of using the duplex laminate 10 illustrated in FIGS. 1 and 2. A particular advantage of the laminate is the integrated construction of the several components thereof in a compact assembly. In paper form, the two facesheets 12,14 may be printed in any suitable manner, such as by using a typical laser printer 30, illustrated schematically in FIG. 2, to print any desired information on the exposed outer surfaces of either or both facesheets.

As shown in FIG. 1, the label 20 may be used as a shipping label upon which is printed the shipping address 32 of the recipient. After printing, the shipping label 20 illustrated in FIG. 1 is removed from the underlying pocket 16 by being simply peeled away therefrom. The so removed shipping label 20 is then applied to any suitable shipping container or package 34, as shown in FIG. 3, by using the same adhesive on the back of the label for permanently bonding the label to the package.

The liner 22 may then be removed from the rim 18 of the first facesheet 12 and discarded. The first facesheet 12 is then used as a holder for a conventional packing slip or sheet 36 which lists the contents of the package 34. The adhesive rim 18 is simply applied to any convenient location on the package 34 and adhered thereto using the original adhesive thereon, with the central pocket 16, which is devoid of adhesive, defining a pouch with the surface of the package in which the packing slip 36 may be conveniently trapped.

The label 20 and pocket 16 from the common duplex laminate are separated from each other and separately used on the package 34, for example at different locations thereon. The shipping label 20 identifies the intended recipient for conventional delivery of the package. And, the pocket 16 conveniently provides a pouch or holder for the packing slip 36 on the external surface of the package for use in a conventional manner. The same duplex laminate illustrated in FIG. 1 therefore provides both the shipping label and the packing slip holder or pouch in one convenient and relatively inexpensive laminated product.

Figure 4:
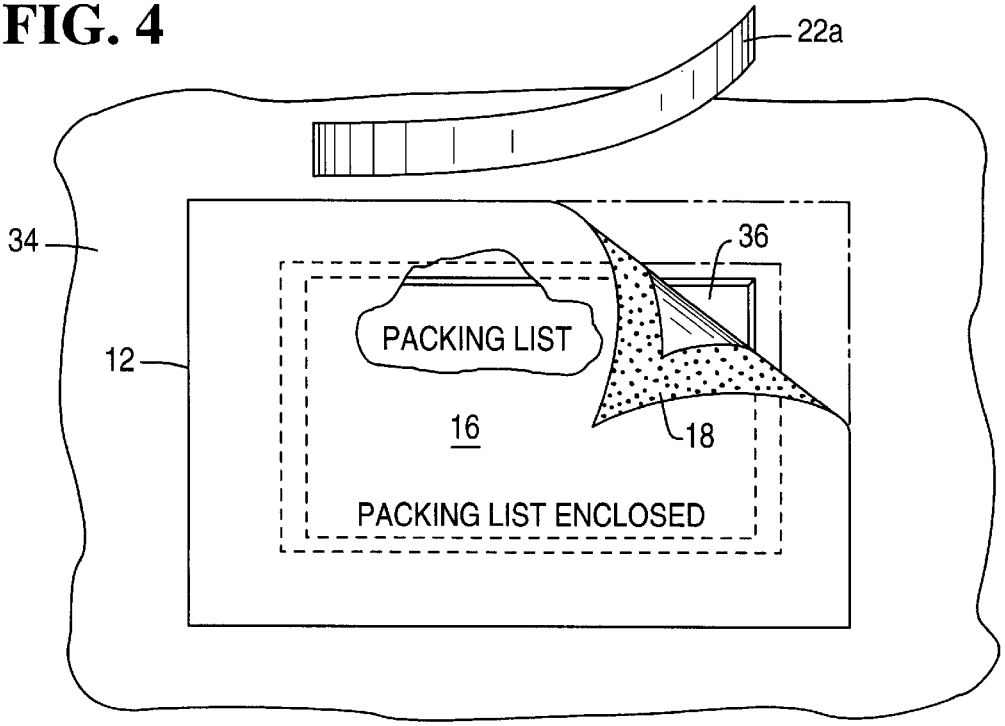
FIG. 4 is a top view of the shipping pocket illustrated in FIG. 3 being applied to the container.

An additional advantage of die cutting the top liner strip 22*a* illustrated in FIG. 1 from the remaining U-shaped portion of the liner 22 is the additional convenience of using the duplex laminate as illustrated in FIGS. 3 and 4. The remaining three liner strips joined together in the U-shaped configuration of FIG. 3 is first removed from the pocket rim 18 so that the rim 18 may be adhered to the package, with the pouch formed inside the pocket being accessible along the top liner strip 22*a* which remains laminated to the rim for this purpose. The top strip 22*a* prevents exposure of the underlying adhesive 28 for permitting insertion of the packing slip without inadvertent bonding to the pocket rim. The top liner strip 22*a* is readily bendable with the corresponding rim section for defining a flap permitting access to the inside of the pocket.

As shown in FIG. 4, after the packing slip 36 is fully inserted inside the pouch, the top liner strip 22*a* may be removed, and the remainder of the pocket rim 18 pressed against and adhered to the underlying package to close the pouch for fully trapping the packing slip therein.

Figure 5:
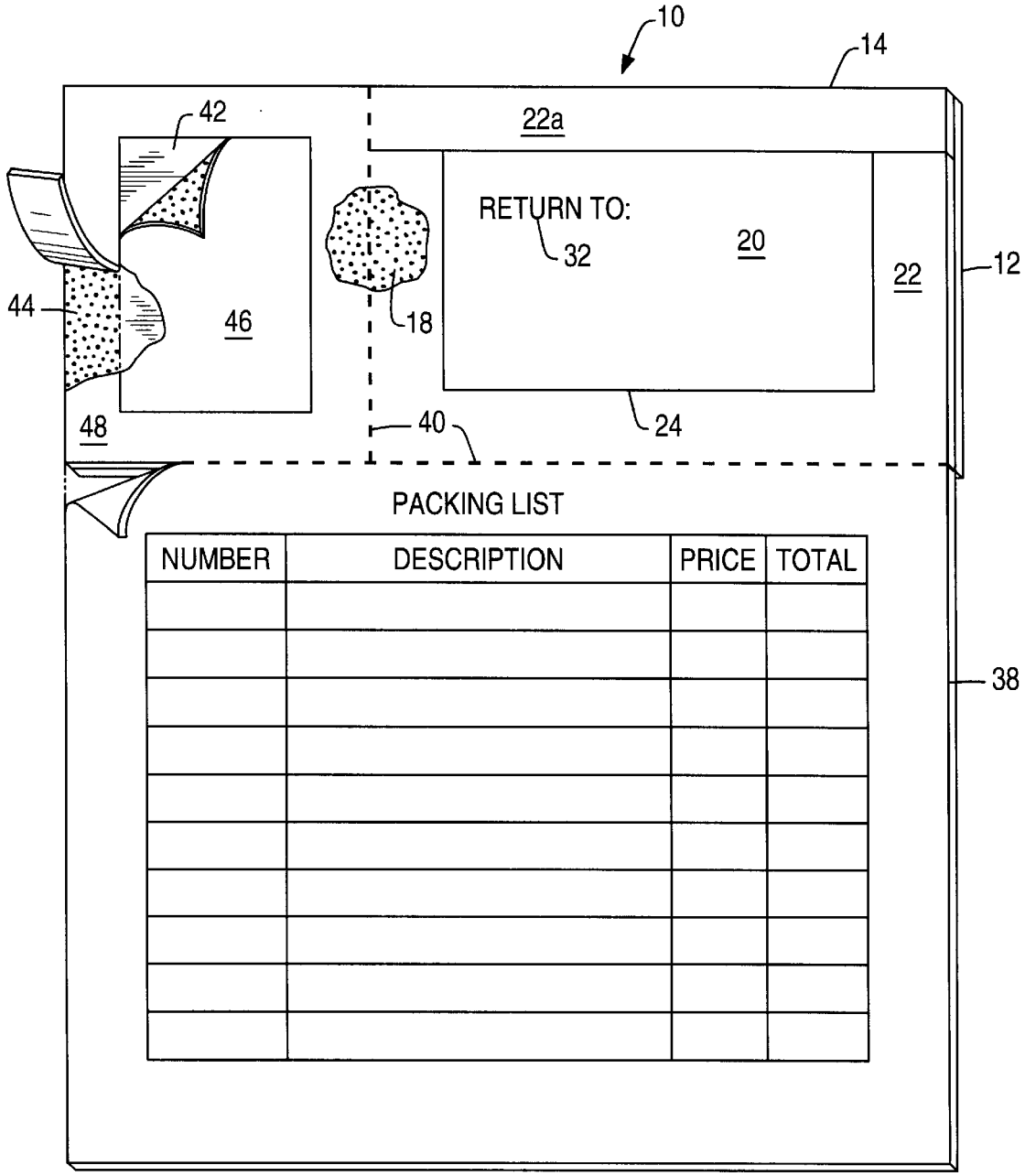
FIG. 5 is a top view of a duplex laminate including an integral form sheet in accordance with another embodiment.

Illustrated in FIG. 5 is another embodiment of the duplex laminate 10 including a form sheet 38 extending integrally from the two facesheets 12,14. The form sheet 38 is preferably integral with either one of the two facesheets, such as the second facesheet, in a unitary single ply therewith. In alternate embodiments, the form sheet 38 may be lap joined to either of the two facesheets.

A line of perforations 40 is disposed at the junction between the form sheet 38 and the edge of the liner 22 for permitting the form sheet 38 to be easily torn from the laminate without damage to either the form sheet or the laminate. The form sheet may be used for any suitable purpose such as a packing list or slip having printed thereon any suitable information such as the contents of the shipping package previously described above.

The second facesheet 14 illustrated in FIG. 5 may have any standard configuration such as typical 8.5 by 11 inch paper. The form sheet 38 may extend over a majority of the length of the facesheet and over its full width. And, the first facesheet 12 need only extend over the full width of the sheet top portion for defining the duplex laminate portion thereof.

The label 20 and the surrounding liner 22 may have any suitable size, and may be smaller than the full width of the facesheets as required for providing a suitable packing slip holder as described above.

Accordingly, the laminate may extend in width as illustrated in FIG. 5 for providing an additional duplex label for use as desired. For example, the first facesheet 12 may further include a second label 42 which adjoins to the left in FIG. 5 the pocket rim 18, with adhesive second rim 44 facing the second facesheet 14. The second facesheet 14 further includes an adhesive third label 46 laminated to the first facesheet inside the second rim 44, and a surrounding release-coated liner 48 laminated to the second rim 44.

A vertical line of perforations 40 is disposed through the two facesheets 12,14 between the adjoining rims 18,44 and between the adjoining label liners 22,48. The vertical line of perforations permits removal of the duplex labels and their surrounding borders from the duplex laminate 10 and the form sheet 38 by tearing along the perforations.

The integrated duplex laminate configuration of FIG. 5 may be used in a manner similar to the laminate illustrated in FIGS. 3 and 4. As initially illustrated in FIG. 5, a suitable address 32 may be printed on the main label 20, with suitable data or information being printed on the form sheet 38 in the same pass through the printer prior to removal of the label and sheet from the original laminate.

The so-printed form sheet 38 may then be removed from the laminate by being torn along the horizontal line of perforations 40 and folded as required to generate a packing slip. The duplex labels 42,46 may be used for any desired purpose such as auxiliary shipping or returning labels, or warning labels, or return approval labels, for example, and may be readily removed from the shipping laminate by being torn along the vertical line of perforations. The third label 46 may be removed from the center of the second label 42 and reapplied where desired, with the second label 42 being reapplied where desired upon removal of the rectangular liner 48.

The main label 20 and the pocket defined by the first facesheet 12 may be used in the same manner as described above with respect to FIGS. 3 and 4 for the package 34, with the form sheet 38 being used as the packing slip 36 therein.

Figure 6:
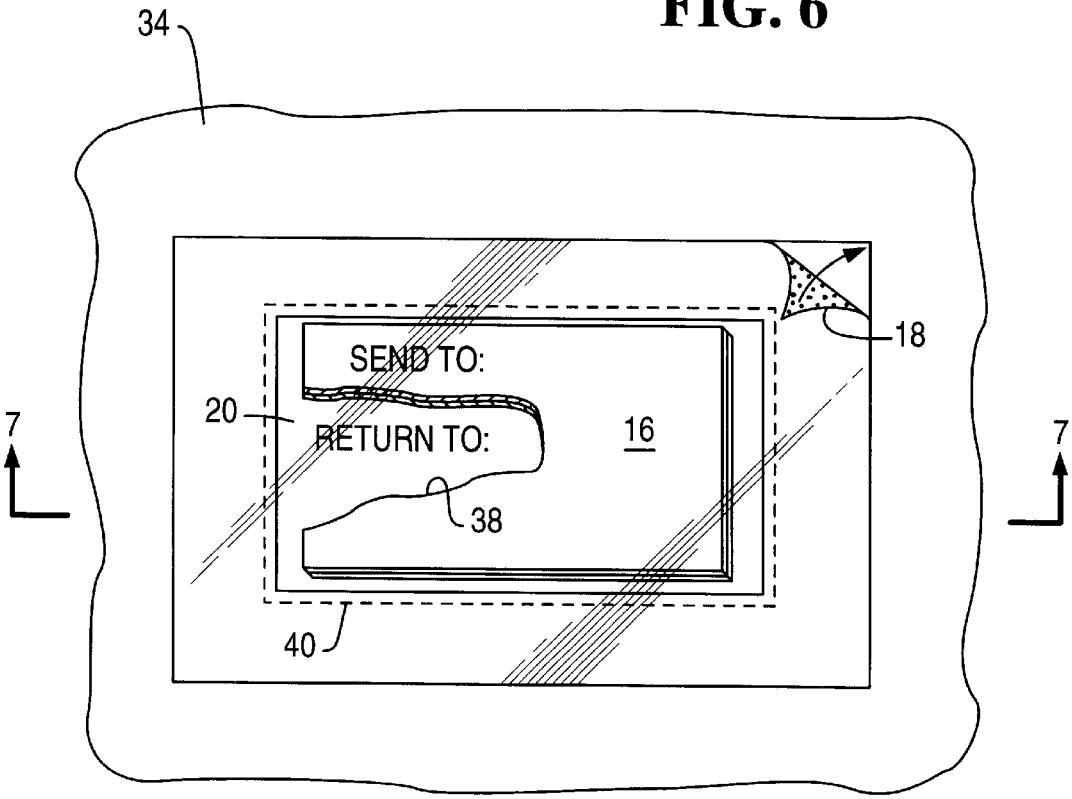
FIG. 6 is a top view of certain components of the laminate illustrated in FIG. 5 being used with a shipping container.
Figure 7:
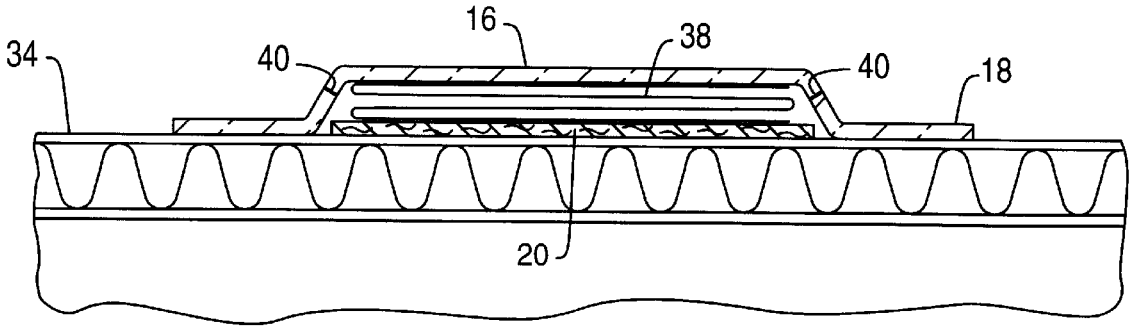
FIG. 7 is a sectional view through the container and laminate components illustrated in FIG. 6 and taken along line 7—7.

However, FIG. 6 illustrates an alternate method of using the duplex laminate in which the shipping label 20 is printed with the return address thereon and adhered to the package 34. The pocket 16 is then placed to cover the main label 20 on the package, with the pocket rim being adhered to the package for trapping the packing slip 38 inside the pouch formed by the pocket, as additionally illustrated in FIG. 7.

The shipping address for the package may be printed on the back, exposed side of the pocket 16 if desired, or the first facesheet including the pocket 16 may be transparent as illustrated in FIG. 6 so that the shipping address may be printed on a suitable portion of the packing slip 38 for being seen through the transparent pocket 16. The first facesheet may be formed of suitably transparent material, such as thin and treated paper, clear polyester, or plastic or other materials as desired.

If desired, the first facesheet may include additional lines of perforations 40 around the perimeter of the pocket 16 so that the recipient of the package may readily remove the packing slip 38 by tearing away the pocket 16 along the surrounding boundary of perforations.

Figure 8:
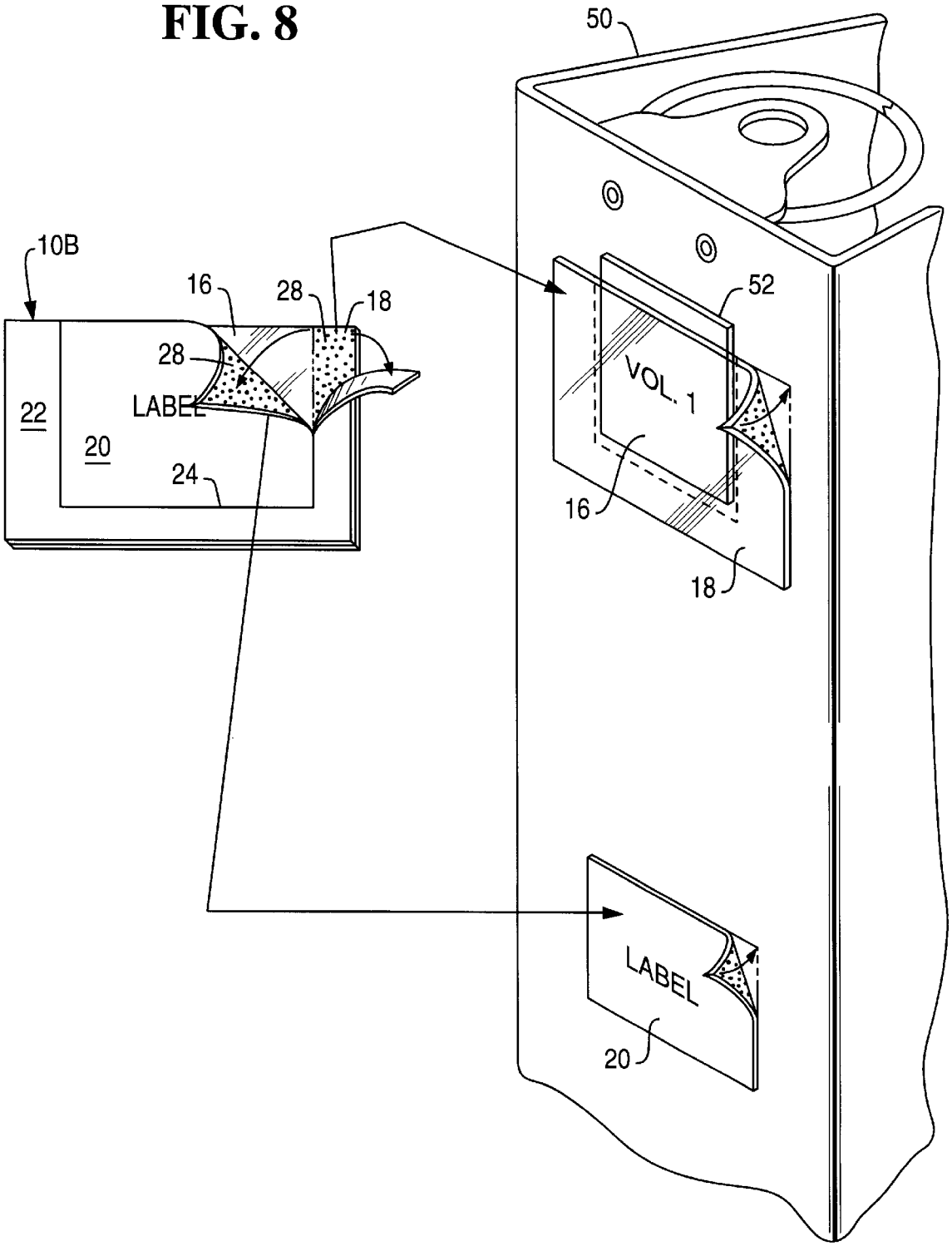
FIG. 8 is an isometric view of a duplex laminate in accordance with another embodiment for use with a loose-leaf binder.

In the FIG. 1 embodiment of the laminate 10, the main label 20 is centrally disposed both horizontally and vertically in the second facesheet 14. FIG. 8 illustrates yet another embodiment of the duplex laminate, designated 10B, in which the main label 20 is again rectangular, but vertically offset and aligned with the top edge of the facesheet so that the liner 22 surrounds the label on only three edges thereof in a generally U-configuration, leaving the top or fourth edge of the label exposed without an adjoining liner.

The liner 22 is therefore continuous in three strips surrounding the label 20 on only three sides, and severed therefrom by the common diecuts 24.

The duplex laminate 10B may be used in a manner similar to the laminate illustrated in FIG. 1, not for labeling a package but instead for labeling the spine of a common looseleaf binder 50, for example. The duplex laminate 10B may be printed with any suitable information, such as identification labels for the binder 50. The main label 20 is then removed from the pocket 16 of the laminate by being peeled away therefrom and then reapplied to a suitable location on the binder for identification purposes.

The liner 22 is removed from the pocket rim 18, and then the rim may also be adhered to the binder to define a pouch between the pocket 16 and the binder.

Since the pocket 16 directly adjoins the top edge of the facesheet, the resulting pouch formed on the binder has an entrance slot which is otherwise closed around the remaining three sides of the pocket by the corresponding adhesive rim. An identification tag 52 may then be readily inserted into the pouch defined between the pocket and binder surface.

The first facesheet defining the pocket 16 may be opaque and formed of paper, for example, so that it may be printed upon and used as an identification label on the binder. The pocket may then be used for containing the tag 52 with any additionally desired information or purpose. Or, the first facesheet may be transparent, as illustrated in FIG. 8, so that printed indicia on the tag 52 may be directly viewed through the transparent pocket 16.

The various embodiments of the duplex laminate disclosed above are relatively simple constructions of two laminated facesheets. The adhesive and release agent are applied to the laminated surfaces of the two facesheets in any desired pattern so that adhesive is found on each of the facesheets in opposition to release on the other facesheets. In this way, the two facesheets may be delaminated for using the two labels in any desired manner.

The patterns of adhesive and silicone release agent may be printed on the two facesheets for lamination thereof. The facesheets may therefore be preprinted if desired before lamination for using either or both surfaces of either or both facesheets for any desired printed information.

The facesheets may be opaque or transparent as desired, and again with or without printing as desired.

And, a duplex laminate in its various configurations having two facesheets may be transported through various forms of conventional printers for printing all the desired information on either or both exposed surfaces of the facesheets for any desired application.

The assembly of the laminate incorporates various adhesive labels and attached form sheets as desired in an integrated construction having maximum flexibility. The labels, packing slip, and packing slip holder are integrated in one assembly, and enjoy substantial advantage over the previously manufactured separate components thereof. The integrated laminate thus has multiple functionality of its various components with a substantial reduction in waste, since only the small area liner is removed and discarded upon use of the laminate.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured Letters Patent of the United States is the invention as defined and differentiated in the following claims in which I claim:

1. A duplex laminate comprising:

a first facesheet having a central release pocket and an adhesive pocket rim surrounding said release pocket; and a second facesheet having a central adhesive label removably laminated to said release pocket, and a border release liner surrounding said label and removably laminated to said adhesive pocket rim.

2. A laminate according to claim 1 wherein said liner laterally adjoins said label at a diecut in said second facesheet.

3. A laminate according to claim 2 wherein said pocket and rim are integral portions of said first facesheet.

4. A laminate according to claim 3 wherein:

said pocket and liner include a release covering inside surfaces thereof; and said label and pocket rim include an adhesive covering inside surfaces thereof, and are removably bonded atop said release covering said pocket and liner, respectively.

5. A laminate according to claim 4 wherein said liner fully surrounds said label, and said diecut fully severs said label from said liner.

6. A laminate according to claim 5 wherein said label is a rectangle, and said liner includes four strips surrounding said label in a larger rectangle.

7. A laminate according to claim 6 wherein one of said liner strips adjoins said label and remaining liner at a common diecut.

8. A laminate according to claim 7 wherein said pocket is opaque.

9. A laminate according to claim 7 wherein said pocket is transparent.

10. A laminate according to claim 7 further comprising a single-ply form sheet extending integrally from said facesheets.

11. A laminate according to claim 10 wherein said form sheet is integral with said second facesheet.

12. A laminate according to claim 11 further comprising a line of perforations disposed between said form sheet and liner.

13. A laminate according to claim 10 wherein:

said first facesheet further includes a second label adjoining said pocket rim, and having an adhesive second rim facing said second facesheet;

said second facesheet further includes an adhesive third label laminated to said first facesheet inside said second rim, and a surrounding liner laminated to said second rim; and a line of perforations is disposed through said first and second facesheets between said pocket rim and second rim and between said label liners.

14. A laminate according to claim 4 wherein said label is a rectangle, and said liner surrounds said label on only three edges thereof, leaving a fourth edge of said label exposed.

15. A laminate according to claim 14 wherein said liner is continuous in three strips surrounding said label.

16. A laminate according to claim 15 wherein said pocket is transparent.

17. A method of using said duplex laminate according to claim 7 comprising:

removing said label from said pocket;

removing said liner from said rim; and adhering said rim to a package, with a slip disposed in a pouch defined between said pocket and package.

18. A method according to claim 17 further comprising adhering said removed label to said package.

19. A method according to claim 18 further comprising printing an address on said label prior to removal thereof from said pocket.

20. A method according to claim 19 wherein said label and pouch are adhered to said package at different locations thereon.

21. A method according to claim 19 wherein said pocket covers said label on said package.

22. A method according to claim 18 wherein:

said one liner strip remains laminated to said rim upon removal of said remaining liner strips, and said pocket rim is adhered to said package with said pouch being accessible along said one liner strip;

said slip is inserted into said pouch under said one liner strip; and said one liner strip is then removed from said rim, and said rim is adhered to said package to close said pouch.

23. A method of using said duplex laminate according to claim 10 comprising:

removing said form sheet from said laminate;

removing said label from said pocket;

removing said liner from said rim; and adhering said rim to a package, with said removed form sheet disposed in a pouch defined between said pocket and package.

24. A method according to claim 23 further comprising:

printing an address on said label and data on said form sheet prior to removal thereof from said laminate; and adhering said removed label to said package.

25. A method of using said duplex laminate according to claim 14 comprising:

removing said label from said pocket;

removing said liner from said rim; and adhering said rim to a binder to define a pouch between said pocket and binder.

26. A method according to claim 25 wherein said pocket is transparent, and further comprising inserting a tag into said pouch.

* * * * *